United States Patent [19]

Keenan et al.

[11] Patent Number: 4,714,169

[45] Date of Patent: Dec. 22, 1987

[54] COLLAPSIBLE/EXPANDABLE SHIPPING RACK

[75] Inventors: Daniel J. Keenan, Rochester; Donald A. Hoss, Southfield, both of Mich.

[73] Assignee: Chrysler Motors Corporation, Highland Park, Mich.

[21] Appl. No.: 30,329

[22] Filed: Mar. 26, 1987

[51] Int. Cl.[4] ..... B65D 19/06

[52] U.S. Cl. ..... 220/8; 220/1.5; 220/6

[58] Field of Search ..... 220/7, 8, 6, 1.5, 4 A, 220/19; 217/13, 45

[56] References Cited

U.S. PATENT DOCUMENTS 2,726,095 12/1955 Emery ..... 220/1.5 X 2,889,924 6/1959 Paulucci ..... 220/8 X 3,459,326 8/1969 Betjemann ..... 220/1.5

*Primary Examiner*—Steven M. Pollard

*Attorney, Agent, or Firm*—Edward A. Craig

[57] ABSTRACT

A collapsible/expandable shipping rack is provided. The rack has a generally rectangular bottom wall. A pair of oppositely disposed end walls are hingedly secured to the bottom wall. The end walls may be pivoted from an upright position to a collapsed position over the bottom wall for storage of the rack. Removable side rails are provided. The side walls extend between the end walls and are removable and storable on the bottom wall for storage of the rack. The end wall walls have width expanding sections which are movable on track means to alter the width of the rack. The end walls also have a height expanding section which are movable on track means to alter the height of the rack.

5 Claims, 8 Drawing Figures

COLLAPSIBLE/EXPANDABLE SHIPPING RACK

BACKGROUND OF THE INVENTION

1. Field of the Invention

This invention relates to a collapsible/expandable shipping rack having an erected configuration and a storage configuration. The end walls are expandable both horizontally and vertically to alter the size of the rack.

2. Prior Art

In modern manufacturing, it is common practice to assemble completed units at a single location from various parts and components which are shipped to the assembly location from other locations. The parts and components are normally fabricated in facilities remote from the assembly location and shipped to the assembly location in containers. Two problems have arisen in connection with prior art containers. One type of container which has been in common use in the past is the throw-away container. Such containers are fabricated of materials such as cardboard and low grade wood. Throw-away containers have presented a serious disposal problem at assembly plants. Additionally, such throw-away containers are not available in units of sufficient strength to ship heavy parts and components.

Reusable racks fabricated of heavy duty steel have been in common use in the past. Such racks are strong in construction and are capable of retaining heavy parts and components. These racks have had the disadvantage of being expensive to transport empty back from an assembly location to the location of the origin of parts and components for refilling and reshipment.

Collapsible racks have been suggested to reduce the volume of empty racks for reshipment. However, collapsible racks fabricated of steel have still suffered from the disadvantage of being quite heavy which involves expensive reshipment costs. Also, such collapsible racks have suffered from a low return ratio. The return ratio is the ratio between the volume of a fully erected container and a collapsed and stored container. Further, such racks made of steel have suffered a rust problem. Prior art racks have also been of a fixed size thus requiring an extensive inventory of rack sizes to suit the various differently sized parts and components.

In accordance with the present invention a collapsible rack is provided which has a relatively high return ratio, the return ratio being approximately 3:1. Further, the rack is fabricated of a combination of plastic and light weight aluminum materials thus reducing the weight substantially, for example, illustratively from over 1000 pounds for a dunnage rack 106 inches long by 48 inches wide and 41 inches high. A similar rack made in accordance with the present invention has exterior dimensions of 96 inches by 51 inches by 51 inches and weighs approximately 360 pounds. Furthermore, the end walls of the rack are expandable both vertically and horizontally to permit variation in the interior rack size thus facilitating loading the rack with variously sized parts and components. For example, the rack may be loaded with automotive gas tanks which vary considerably in size from those used on smaller vehicles to those used on larger vehicles. The rack size can be tailored to the particular size of the gas tanks being shipped.

SUMMARY OF THE INVENTION

The collapsible/expandable shipping rack comprises a generally rectangular bottom wall having a pair of oppositely disposed end walls. Hinge means are provided to secure each end wall at the lower marginal edge thereof to the bottom wall. Each end wall is adapted to be pivoted from an upright position to a collapsed position over the bottom wall. Each end wall includes a central support section. The central support section is secured by the hinge means to the bottom wall.

A pair of width expanding sections are provided. Horizontal track means are provided on the central support section. Each of the width expanding sections are mounted on the horizontal track means for horizontal movement to expand or contract the width of the rack. First latching means are provided on the central support section to releasably latch the width expanding sections in a desired position.

A height expanding section is also provided. Vertical track means are provided on the central support section. The height expanding section is mounted on the vertical track means for vertical movement to expand or contract the height of the rack. Second latching means are provided on the central support section to releasably latch the height expanding section in a desired position.

A plurality of side rails are provided of a length to extend between the width expanding sections when the end walls are in an upright position to form a sidewall structure. Third latching means are provided on the width expanding sections to releasably latch the side rails to the width expanding sections. The side rails maintain the end walls in an upright position when latched in place. The side rails are removable by unlatching the third latching means to permit pivoting of the end walls into a collapsed position over the bottom wall. The bottom wall includes an elongated central recess to receive loose side rails for storage purposes. The third latching means are detachably mounted on the width expanding sections. The width expanding sections include mounting structure to receive the third latching means at a plurality of locations and in varying numbers to modify the locations and numbers of side rails.

The horizontal track means comprises a plurality of vertically spaced apart horizontally extending tubular members forming a portion of the central support section. The width expanding sections include a plurality of vertically spaced apart horizontally extending rail members slidably received in the tubular members. The vertical track means comprises a plurality of horizontally spaced apart vertically extending tubular members also forming a portion of the central support section. The height expanding sections include a plurality of horizontally spaced apart vertically extending rail members which are slidably received in the appropriate tubular members.

The bottom wall includes a pair of spaced apart elongated tubular members extending between the end walls. The space between the tubular members defines the elongated central recess to receive the side rails for storage purposes. The bottom wall tubular members are open ended to receive the fork of a fork lift truck at either end of the rack for manipulation of the rack.

DETAILED DESCRIPTION OF A PREFERRED EMBODIMENT

Figure 1:
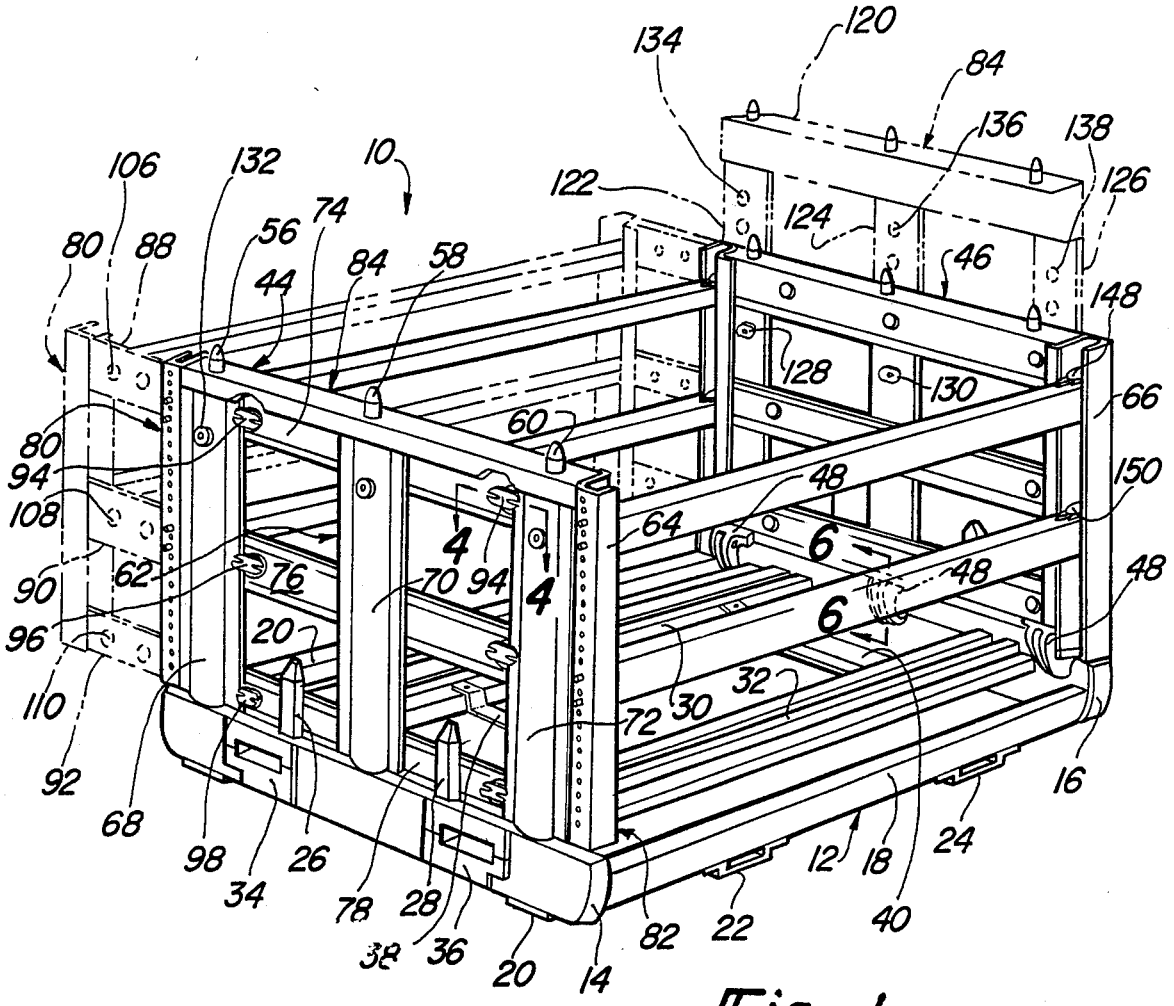
FIG. 1 is a view in perspective of one embodiment of the collapsible/expandable shipping rack in accordance with the present invention shown in the erected condition.

Referring to FIGS. 1, 2, 3, 6 and 7, it will be noted that the collapsible/expandable shipping rack 10 comprises a generally rectangular bottom wall 12. The bottom wall 12 includes end pieces 14, 16 and side pieces 18, 20 joined together to form a rectangle. Ground engaging foot pads 20 are provided on the underside of each corner. A pair of brackets 22, 24 are provided on each side piece 18, 20 for engagement of a fork of a fork lift truck for manipulation of the rack 10 as desired. A pair of upwardly extending projections 26, 28 are provided on each end piece 14, 16. The projections 26, 28 are received in opening means on the underside of the end pieces 14, 16 of a superadjacent collapsed rack 10 to facilitate stacking of collapsed racks one upon the other for storage and shipping purposes. The bottom wall 12 further includes a pair of spaced apart elongated tubular members 30, 32 which extend between the end pieces 14, 16 and add structural rigidity to the construction of the bottom wall 12. The tubular members 30, 32 are open ended to receive the fork of a fork lift truck at either end of the rack 10 for manipulation of the racks as desired. Protective plates 34, 36 are provided on the end pieces 14, 16 with openings therein to permit access to the tubular members 30, 32. The plates 34, 36 guard against damage to the rack 10 by the fork of a fork lift truck.

Spaced apart support bars 38, 40 are secured between the tubular members 30, 32. It will be noted that the bars 38, 40 are recessed downwardly in the space between the tubular members 30, 32 to define an elongated central recess between the tubular members 30, 32. This recess receives loose rack side rails 42 for storage purposes when the rack 10 is collapsed, two rails 42 illustratively being shown in dotted lines in the stored position in FIG. 7.

Figure 6:
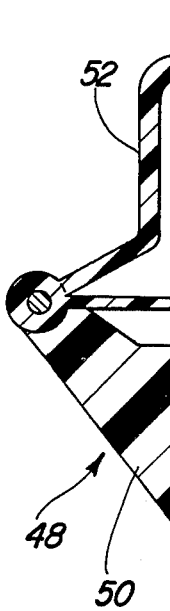
FIG. 6 is a sectional view taken substantially along the line 6—6 of FIG. 1 looking in the direction of the arrows.
Figure 7:
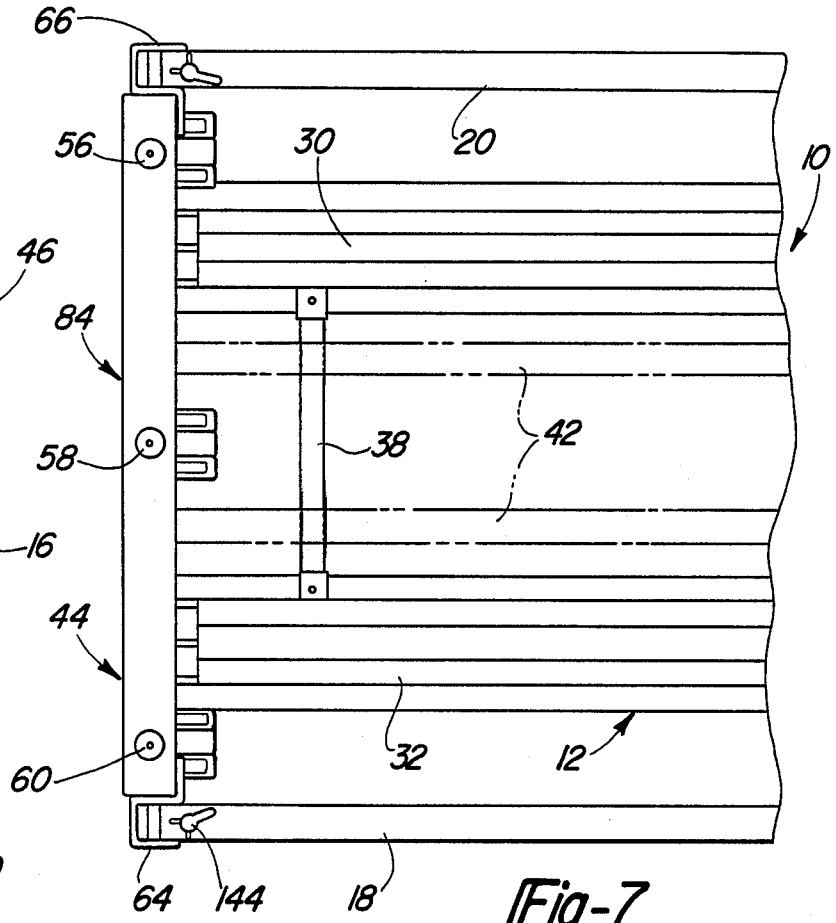
FIG. 7 is a partial top plan view of the rack of FIG. 1.
Figure 2:
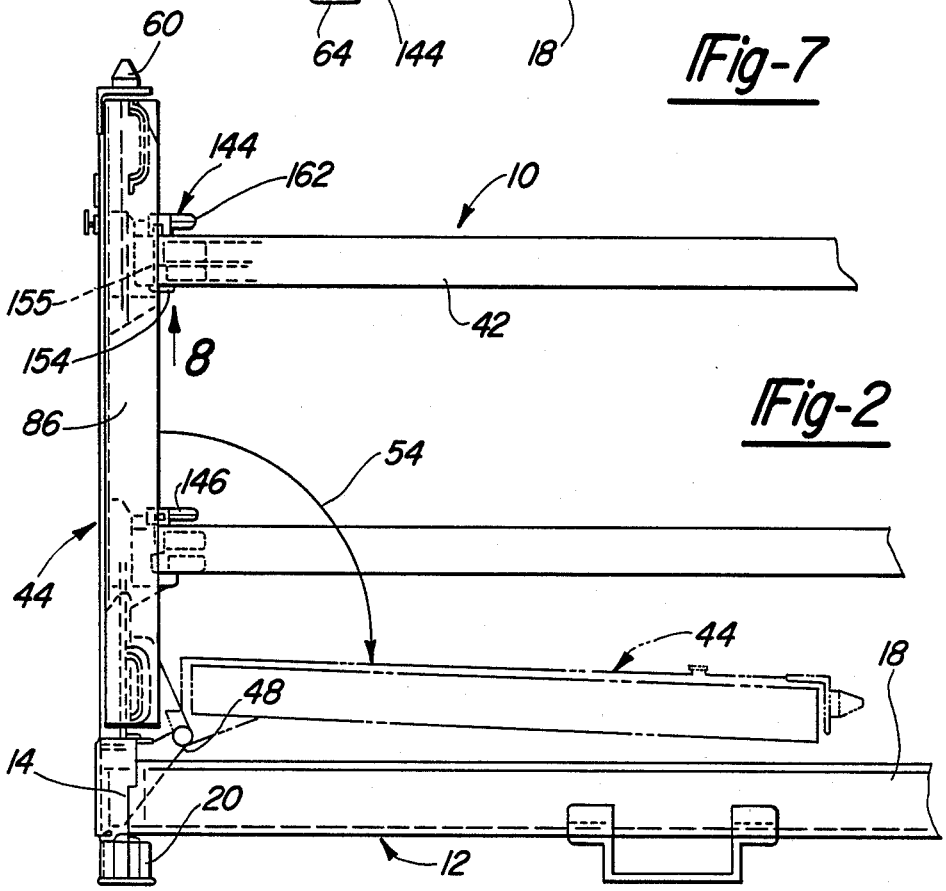
FIG. 2 is a view of the left end of the rack as viewed in FIG. 1 illustrating collapsing of an end wall into the bottom wall.
Figure 3:
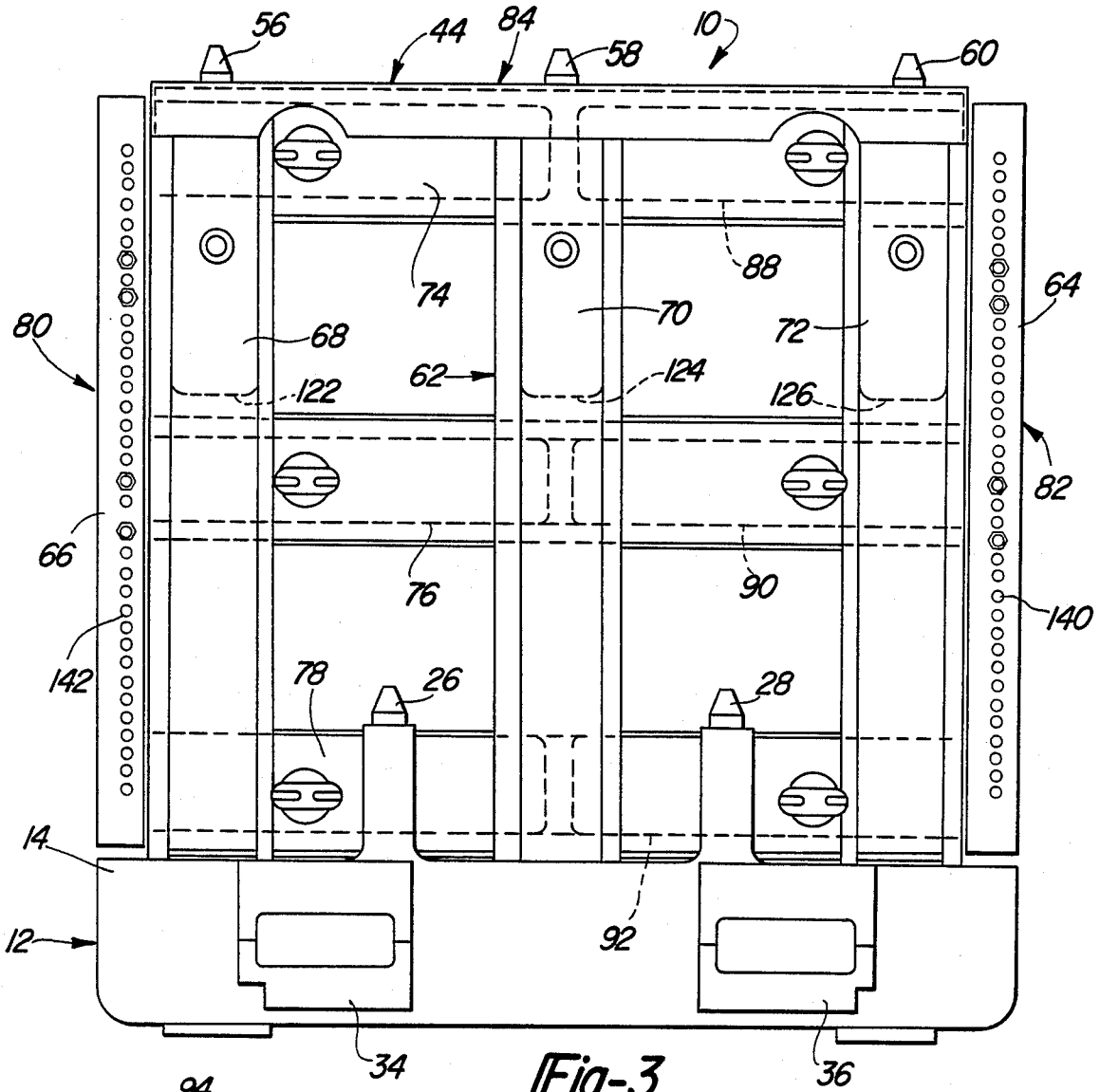
FIG. 3 is an end view in elevation of the rack of FIG. 1.

A pair of oppositely disposed end walls 44, 46 are hingedly secured at the lower marginal edges thereof to the bottom wall 12. As will be noted in FIGS. 1, 2 and 6, three hinges 48 are provided for securement of each of the end walls 44, 46 to the bottom wall 12. The hinges 48, as shown in FIG. 6, comprise one hinge member 50 secured to the bottom end piece and another hinge member 52 secured to the end wall. As will be noted in FIG. 2, the end walls may be pivoted in the direction of the arrow 54 from an upright position to a collapsed position over the bottom wall 12. Three projections 56, 58, 60 are provided on the upper edge of each end wall for reception in opening means on the bottom wall end pieces 14, 16 to permit stacking of erected racks, one upon the other. However, when the end walls are collapsed as shown in FIG. 2, the other previously mentioned projections 26, 28 are used for stacking purposes.

Each end wall comprises a cental support section 62. The central support section is secured by the hinge means 48 to the bottom wall 12. Each central support section comprises a plurality of horizontally spaced apart vertically extending tubular members 68, 70, 72 which are secured to a plurality of vertically spaced apart horizontally extending tubular members 74, 76, 78. These tubular members not only establish the structure of the central support sections but also provide horizontal track means for a pair of width expanding sections 80, 82 and vertical track means for a height expanding section 84.

Each of the width expanding sections 80, 82 includes an end rail 86 which is U-shaped in cross-section. A plurality of vertically spaced apart horizontally extending rail members 88, 90, 92 extend from the end rail 86 and are slidably received in the horizontal tubular members 74, 76, 78. This mounts the width expanding sections 80, 82 for horizontal movement to expand or contract the width of the rack 10 as will be noted in FIG. 1. First latching means 94, 96, 98 are provided on horizontal tubular members 74, 76, 78. A plurality of openings 106, 108, 110, spaced about an inch and a half apart, are provided in the rails of the width extending sections for the latching means.

Figure 4:
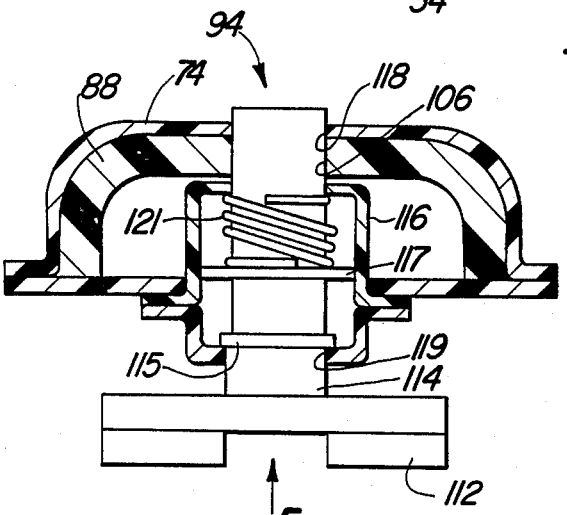
FIG. 4 is a view taken substantially along the line 4—4 of FIG. 1 looking in the direction of the arrows.
Figure 5:
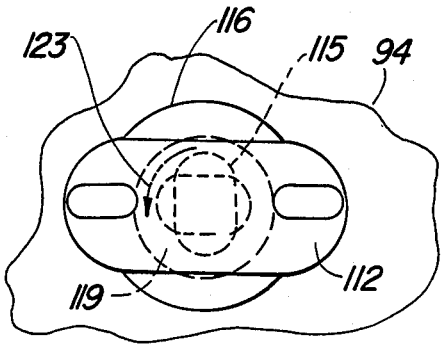
FIG. 5 is a view in the direction of arrow 5 of FIG. 4.

As shown in FIGS. 4 and 5, the latching means comprise a knob 112 which is accessible externally of the ends of the rack 10. The knob 112 is operatively connected to a latch pin 114. The latch pin 114 is slidingly received in a casing 116 which is illustratively secured to horizontal tubular member 74. The latch pin 114 passes through one of the openings 106 and thence through an opening 118 in the tubular member. An oval latch 115 is provided on latch pin 114. The latch is positioned crossways with respect to an oval opening 119 in casing 116 to releasably latch the width expanding section in a desired position. A circular stop member 117 is provided on pin 114. A coil spring 121 is compressed between stop member 117 and the casing 116. When the width expanding sections are to be moved, the knob 112 is turned in the direction of arrow 123 to align latch 115 with opening 119 thus permitting movement of the latch 115 through opening 119 and disengagement of the latch pin 114 from opening 106. This movement is assisted by the spring 121. The stop member 117 prevents the latch pin 114 from falling out of the casing 116. Release of the latch permits adjustment of the width expanding section as desired. It is only necessary to realign the latch pin 114 with one of the openings 106 in order to resecure the width expanding section in place.

A similar construction is provided for the height expanding section 84. The height expanding section 84 includes an upper rail 120 having a plurality of horizontally spaced apart vertically extending rail members 122, 124, 126 which are slidably received in tubular members 68, 70, 72. This provides for the height expanding section 84 being mounted on vertical track means for vertical movement to expand or contract the height of the track 10. Second latching means 128, 130, 132 are provided on the central support section 62 to releasably latch the height expanding section 84 in a desired position. These latching means are the same as previously described for the width expanding sections excepting that the actuating knobs are provided interiorly of the rack and a protective disc is provided on the outer ends of the latch pins. Opening means 134, 136, 138 are provided in the rails 122, 124, 126 to receive the latch pins as previously described.

The side rails 42 complete the construction of the rack 10. As will be noted, the U-shaped end rails 64, 66 are provided with a plurality of vertically spaced apart openings 140, 142. These opening means are utilized to mount and position third latching means 144, 146, 148, 150 a portion of which is mounted within the end rails 64, 66 by means of nut and bolt structures which extend through the openings. The detachable mounting of these latching means on the width expanding sections 80, 82 permits the latching means to be placed at a plurality of locations as desired and to be varied in number so as to receive different numbers of side rails 42. The number and location of side rails 42 is dependent upon the intended type of contents to be held by the rack 10. If relatively small items are to be retained, more rails 42 will be used and the location thereof will be shifted. Larger items require fewer rails and different locations of the side rails 42. As will be noted in FIG. 1, the side rails 42 are carried with the width expanding sections 80, 82 when the rack 10 is enlarged or contracted in width.

Figure 8:
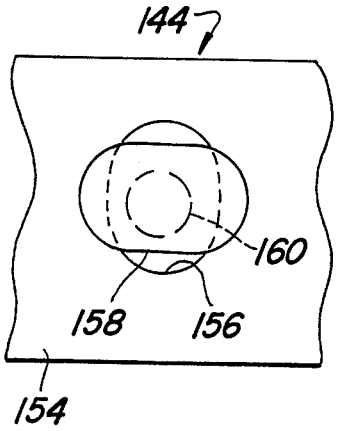
FIG. 8 is a view in the direction of arrow 8 of FIG. 2.

FIGS. 2 and 8 illustrate the construction of the third latching means. As will be noted, each latching means includes a support body 154 mounted in the end rail 86 which receives an end of the side rail 42. The side rail has mounted in the end thereof a latch body 155. The support body 154 has an oval opening 156 through which an oval latch element 158 will pass when properly oriented. The latch element 158 is mounted on a stem structure 160 to which is attached a knob 162. The rails 42 are secured in place by first orienting the latch element 158 by means of the knob 162 to pass through the oval opening 156. After the latch element has passed through this opening, it is turned by means of the knob 162 so that it is out of alignment with the opening 156 thereby latching the rail 42 in place.

The side rails 42, when mounted in place, maintain the end walls 44, 46 in an upright position. The side rails 42 may be removed by first unlatching them and then lifting them out of the latching means. As previously mentioned, loose side rails 42 are stored on the bottom wall 12. After the side rails have been removed and stored, the end walls 44, 46 are pivoted into a collapsed position over the bottom wall 12.

The rack 10 is preferably fabricated of lightweight materials. For example, plastic materials such as nylon or polypropelene may be used. Parts subject to heavy loads, such as the bottom wall 12, may be reinforced by use of fiberglass. The side rails 42 may be fabricated of either a plastic material or a light weight metal such as aluminum.

We claim:

1. A collapsible/expandable shipping rack comprising a generally rectangular bottom wall, a pair of oppositely disposed end walls, hinge means securing each end wall at the lower marginal edges thereof to the bottom wall, each end wall adapted to be pivoted from an upright position to a collapsed position over the bottom wall, each end wall comprising a central support section which is secured by the hinge means to the bottom wall, a pair of width expanding sections, horizontal track means on the central support section, each of the width expanding sections being mounted on the horizontal track means for horizontal movement to expand or contract the width of the rack, first latching means on the central support section to releasably latch the width expanding sections in a desired position, a height expanding section, vertical track means on the central support section, the height expanding section being mounted on the vertical track means for vertical movement to expand or contract the height of the rack, second latching means on the central support section to releasably latch the height expanding section in a desired position, a plurality of side rails of a length to extend between the width expanding sections when the end walls are in an upright position to form a side wall structure, third latching means on the width expanding sections to releasably latch the side rails to the width expanding sections, the side rails maintaining the end walls in an upright position when latched in place and being removable by unlatching the third latching means to permit pivoting of the end walls into a collapsed position over the bottom wall.

2. A collapsible/expandable shipping rack as in claim 1, further characterized in that the bottom wall includes an elongated central recess to receive the side rails for storage purposes.

3. A collapsible/expandable shipping rack as in claim 1, further characterized in that the third latching means are detachably mounted on the width expanding sections, said width expanding sections including mounting structure to receive the third latching means at a plurality of locations and in varying numbers to modify the locations and numbers of side rails.

4. A collapsible/expandable shipping rack as in claim 1, further characterized in that the horizontal track means comprises a plurality of vertically spaced apart horizontally extending tubular members forming a portion of the central support section, the width expanding sections including a plurality of vertically spaced apart horizontally extending rail members slidably received in said tubular members, the vertical track means comprising a plurality of horizontally spaced apart vertically extending tubular members forming a portion of the central support section, the height expanding section including a plurality of horizontally spaced apart vertically extending rail members slidably received in said last mentioned tubular members.

5. A collapsible/expandable shipping rack as in claim 2, further characterized in that the bottom wall includes a pair of spaced apart elongated tubular members extending between the end walls, the space between the tubular members defining said elongated central recess, said tubular members being open ended to receive the fork of a fork lift truck at either end of the rack for manipulation of the rack.

* * * * *